US006413064B1

(12) United States Patent
Parsch et al.

(10) Patent No.: US 6,413,064 B1
(45) Date of Patent: Jul. 2, 2002

(54) PUMP

(75) Inventors: Willi Parsch, Bickenbach; Dirk Webert, Bad Homburg, both of (DE)

(73) Assignee: LUK Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 09/762,789

(22) PCT Filed: Aug. 13, 1999

(86) PCT No.: PCT/DE99/02529

§ 371 (c)(1),
(2), (4) Date: Feb. 13, 2001

(87) PCT Pub. No.: WO00/09888

PCT Pub. Date: Feb. 24, 2000

(30) Foreign Application Priority Data

Aug. 13, 1998 (DE) ..... 298 23 902 U
Aug. 13, 1998 (DE) ..... 298 23 903 U

(51) Int. Cl.[7] ..... F04C 15/00
(52) U.S. Cl. ..... 418/149; 418/15; 92/86
(58) Field of Search ..... 418/149, 15; 92/86

(56) References Cited

U.S. PATENT DOCUMENTS 2,909,124 A * 10/1959 Maisch ..... 418/149
3,035,554 A * 5/1962 Selzler ..... 418/149
3,053,191 A * 9/1962 Weigert ..... 418/149
3,292,551 A * 12/1966 Gordon ..... 418/149
3,294,028 A * 12/1966 Dahl ..... 418/149
3,294,029 A * 12/1966 Clark et al. ..... 418/149
3,373,693 A * 3/1968 McKittrick ..... 418/149
3,416,459 A * 12/1968 Reimer et al. ..... 418/149
3,473,476 A * 10/1969 Davidson ..... 418/149
3,575,538 A * 4/1971 Berkowitz ..... 418/149
3,587,405 A * 6/1971 Holmes ..... 92/86
3,885,896 A * 5/1975 Ruf ..... 418/149
4,182,602 A 1/1980 Dworak et al.
4,945,724 A * 8/1990 O'Neal ..... 92/86
5,496,152 A 3/1996 Heise et al.
5,997,268 A * 12/1999 Peach et al. ..... 418/149

FOREIGN PATENT DOCUMENTS

DE 2700381 7/1978
DE 3928029 3/1990
DE 4122433 1/1993
DE 4138516 5/1993
JP 55-087881 * 7/1980 ..... 418/149

* cited by examiner

*Primary Examiner*—Thomas Denion
*Assistant Examiner*—Theresa Trieu
(74) *Attorney, Agent, or Firm*—Alston & Bird LLP

(57) ABSTRACT

A rotary vane pump for delivering a fluid, having a delivery device accommodated in a casing (2), a casing cover (3) arranged on one end face, and optionally with a bearing flange (4) adjoining the casing (2) on the side opposite to the casing cover (3). A seal (5,6) is arranged between the casing (2) and the casing cover (3) and optionally between the casing (2) and the bearing flange (4), and the seal (5,6) is inserted into a groove (8,9) formed in the casing cover (3), and optionally in the bearing flange (4), and/or in the respective end face (7) of casing (2). Also a leakage path (13) for the fluid extends between a delivery side (11) and suction side (12). The leakage path (13) extends on the inner side (14) of the seal at least in sections parallel to the seal (5,6).

15 Claims, 8 Drawing Sheets

PUMP

BACKGROUND OF THE INVENTION

The invention relates to a pump for delivering a fluid, in particular a rotary vane pump, of the type having a delivery device accommodated in a casing, a casing cover on one end face, and a bearing flange adjoining the casing on the opposite side of the casing cover. The delivery device serves to displace the fluid from a suction side to a delivery side of the pump.

The pump of the described type may further have a feed channel for the fluid, which is formed in the casing and extends into the suction side of the delivery device, and an injector device serving to deliver the fluid, wherein the injector device injects the fluid under high pressure into the fluid exiting from the feed channel into an upstream jet chamber, thereby entraining or accelerating same.

Pumps of the kind under discussion, for example rotary vane pumps, are adequately known from practice, for example from DE 39 28 029 A1, DE 41 22 433 C2, and DE 41 38 516 A1.

Pumps of the described type are used, for example in power steering systems, and they deliver a special oil for purposes of assisting the steering force being applied to the steering wheel of an automobile. Preferably, the pumps are rotary vane pumps, which take in oil from a reservoir provided outside of the pump, preferably an external tank. Normally, such pumps are equipped with a flow control valve, which permits directing oil from the high-pressure or delivery side, to the suction side of the pump. Effective a certain rotational speed of pump and with a constantly adjustable delivery, the flow control valve opens a discharge bore, through which oil under high pressure is allowed to leave. The oil enters the suction chamber of the delivery device.

On the delivery side of the pump, leakages occur constantly, so that special measures are needed for removing the leakage oil. To this end, leakage paths leading to the suction side are provided in pumps of the art, so that the leakage oil is again supplied to the oil directed from the tank into the pump. Measures realized so far with respect to leakage paths or leakage oil channels involve a significant manufacturing expenditure and, consequently, represent quite a relevant cost factor in the manufacture of the pump.

U.S. Pat. No. 5,496,152 discloses a rotary vane pump, which comprises for purposes of realizing as much as possible a cavitation-free operation, a very special arrangement for delivering the tank oil, namely an injector device, which operates similarly to a water jet pump. The injector device receives fluid under high pressure, which is supplied to the injector device from the high-pressure side. The injector device injects this high-pressure fluid into the stagnant fluid from the feed channel, namely in the region of a jet chamber upstream of the delivery device. As a result, the fluid coming from the tank is entrained or accelerated, and enters from there, via a further channel system, the suction side of the delivery device.

However, the technique disclosed in U.S. Pat. No. 5,496,152 and relating to the use of an injector device is problematic in that this injector device operates only on one side of the casing with a jet nozzle, from where it must deliver the fluid coming from the tank to both sides of the casing, in the respective suction zone, for purposes of making the fluid available in an adequate amount on both sides of the casing to the suction chambers associated to both sides of the delivery device or rotary group. Due to the differently long flow paths to the suction chambers arranged on both sides, different pressure conditions occur in the fluid, which results again in a varying supply of fluid to the suction chambers on both sides. This leads to cavitation or damage resulting from cavitation, in particular in the case of high delivery rates of the pump. Furthermore, a uniform filling of the suction zones on both sides is questionable.

It is the object of the present invention to improve and further develop a pump of the described type such that it enables a reliable removal of the leakage oil on the delivery side, while simultaneously reducing constructional and manufacturing measures. Furthermore, it is desired to ensure a uniform admission of fluid to the cells of the delivery device. Damage due to cavitation is to be prevented effectively.

SUMMARY OF THE INVENTION

The above and other objects and advantages of the invention are achieved by the provision of a pump of the described type wherein a seal is disposed between at least one of (1) the casing cover and one end face of the casing and (2) the bearing flange and the other end face of the cover. The fluid leakage path extends between the delivery side and the suction side, with at least a portion of the leakage path extending along the inner side of the seal.

In accordance with the invention, it has been recognized that it is possible to design and construct the leakage path, so that it extends at least in sections parallel to the seal. The arrangement of the leakage path close to the seal relieves the seal on the delivery side. Consequently, the arrangement of the seal achieves not only a reliable removal of the fluid or leakage oil, but also a reliable relief of the seal, thereby assisting the sealing effect in the long run. The leakage path is provided wherever leakage oil emerges, which is to be removed on the delivery side. Consequently, the leakage path extends at least in sections parallel to the seal, namely on the inner side or media side of the seal.

From manufacturing aspects, it will be quite especially advantageous, when a groove that is anyway provided for the seal, is used as leakage path. This groove is formed either in the casing cover or, if present, in the bearing flange or in the respective end face of the casing, and it is actually used for inserting or receiving the seal. For example, the groove may be made integral with the respective component.

To use this groove as leakage path, the groove is made at least in part wider than the seal toward the inner side of the seal or media side, so that the groove forms on the inner side of the seal the leakage path that extends parallel to the seal directly adjacent thereto.

Within the scope of such a constructional measure, the seal is directly relieved only on its inner side. At the same time, it is lubricated on its inner side and cooled, if need arises. In the case of a wide construction of the groove, the later has a double function, namely, on the one hand, the accommodation of the seal, and on the other hand, the arrangement of a leakage path or leakage channel. Since the groove is needed anyway for receiving the seal, manufacturing expenditure is reduced quite considerably. Furthermore, this measure reduces the overall space needed as a whole, so that it assists a miniaturization of the pump.

Very advantageously, the groove is designed and constructed as a self-contained, peripheral annular groove, so that a gasket is is suitable for use as a seal. As previously stated, the groove may be widened over its entire length, so that the leakage path extends over the entire length of the seal on the inner side of the seal or media side. Likewise, it is possible to extend the leakage path as a widening of the groove only in part over the length of the groove, namely wherever leakage oil emerges that is to be removed.

Concretely, the groove could be made as a simple groove with a substantially widened groove bottom (at any rate wider than the normal groove for receiving the seal), so that the seal or gasket can be positioned in the outer region of the groove in contact with the outer groove wall. This results automatically from the dimensioning of the groove on the one hand and the gasket on the other.

It is likewise possible to make the groove stepped toward the groove bottom, with the seal being arranged in the outer step of the groove. Advantageously, the outer groove portion that receives the seal is submerged. Furthermore, it is possible to make the groove as a kind of double groove, with a partition extending between the groove portions and separating same at least in part or to a great extent. According to the foregoing description, one would insert the seal or gasket into the outer groove portion. Advantageously, even this groove portion may be made at least slightly larger than the seal. The inner groove portion will serve as a leakage path.

In an advantage-s manner, the widened portion of the groove, i.e. the leakage path extending parallel to the seal, communicates at least in one location with the suction side of the pump for purposes of effectively removing from the delivery side leakage oil that collects in the leakage path. In this process, the leakage oil is supplied directly to the suction side of the pump and is there again mixed with the tank oil. Naturally, in accordance with the emergence of leakage oil, it is also possible to provide a plurality of flow connections between the leakage path and the suction side. These connections may be bores, recesses, or even a kind of labyrinth, which extends from the groove toward the suction side. At any rate, it is to be ensured in this case that the leakage oil collecting in the leakage path or in the groove is adequately removed toward the suction side.

In connection with the foregoing measures, it will be of advantage, when the entire delivery side, i.e., the high pressure prevailing in the pump, is sealed at least quite predominantly within the interior of the casing, and/or directly adjacent thereto. Within the scope of such a measure, the high pressure within the bore formed for the rotary group of the vane-cell pump is sealed, so that a "real" high pressure no longer prevails outside of this bore, or far removed therefrom, and thus away from the interior of the casing. Consequently, the seal extending in the widened groove is no longer exposed to the "real" high pressure, as is the case with conventional pumps of the species-forming kind, so that likewise to this extent the arrangement of the leakage path is assisted on the one hand with the leakage path itself and on the other hand with the there-adjoining seal.

Further seals that are used for sealing the delivery side are operative toward the casing cover and optionally toward the bearing flange. Likewise in this instance, the seals may be conventional gaskets, which may moreover be provided likewise with a special leakage path, namely each in the form of a widened groove. Last but not least, it is possible to construct even a plurality of grooves, each as a special leakage path, which are used for inserting a seal, for purposes of being able to ensure a particularly effective removal as regards the leakage oil.

The pump of the present invention accomplishes the foregoing objects likewise by the provision of a pump wherein the feed channel on both sides of the delivery device terminates with one subchannel each in a jet chamber, and that the injector device injects on both sides, each time with jet nozzles, so that at least one jet nozzle of the injector device is directed into each of the two jet chambers. Accordingly, the injector device comprises injectors that are directed into each of the two jet chambers, i.e., a total of two injectors. These injectors in turn inject with at least one jet nozzle.

The present invention has so far recognized that one should make available the same amount of fluid under identical conditions on both sides of the casing in each respective suction zone of the delivery device, i.e., directly upstream of the suction chambers of the delivery device. Furthermore, it has been recognized that this kind of making available the fluid is possible, only when the feed channel for supplying the fluid advancing from the tank also terminates in fact on both sides of the delivery device with respectively one subchannel in a jet chamber serving to accelerate the fluid. The acceleration of the there-exiting fluid occurs, on both sides of the casing, in a conventional manner with the use of an injector device which, other than in the previously described prior art, injects bilaterally, i.e., on both sides of the casing, with one jet nozzle each into the respective jet chamber. To this end, one jet nozzle of the injector device is directed into each to the two jet chambers, so that as a result of injecting the high-pressure fluid, the fluid coming from the tank is accelerated or entrained.

In an advantageous manner, the injector device or its inlet is arranged substantially in the center above the delivery device. Such a central arrangement of the injector device has the advantage that the paths extending on both sides of the delivery device for accelerating on the one hand the fluid coming from the tank and on the other hand the high-pressure fluid being used for the injection, have approximately the same length. In a corresponding manner, the fluid entering the suction zones of the delivery device on both sides is under the same pressure, so that it is possible to admit fluid to the delivery device uniformly on both sides.

Concretely and within the scope of a particularly advantageous configuration, the jet nozzles are aligned such that the fluid injected under high pressure via the jet nozzle impacts upon the fluid being accelerated in the direction of its flow or at an acute angle with the direction of its flow. This again assists the acceleration of the fluid coming from the tank, with the high-pressure fluid being distributed already within the injector device to both jet nozzles with a high kinetic energy of the fluid being used for the injection.

As regards the jet nozzles, it will be of advantage, when same have an approximately round shape, so that upon its exit, the fluid forms a kind of jet jacket or cylindrical/conical jet jacket. In comparison with a thin fine jet, a larger contact surface results, which is present twice due to the injection by means of the jet nozzles on both sides. Last but not least, the fluid enters the jet nozzles of the injector device via discharge bores on both sides.

Furthermore, it is important that the subchannels extending from the feed channel that is divided on both sides of the delivery device, and carrying the fluid coming from the tank, have approximately the same length, so that likewise to this extent the same distances are covered by the fluid coming from the tank. After leaving the subchannels, the oil coming from the tank receives the oil injected under high pressure and with a high kinetic energy. As a result, it is accelerated in a way similar to the case of a water jet pump.

Advantageously, the subchannels of the feed channel that is divided on both sides of the delivery device, are made not only of the same length, but also have the same extension. If possible, this extension is made mirror-inverted on both sides.

On the one side of the casing, the pump comprises a cover on its end face, and on the other side of the casing a bearing flange, provided same is needed. To this extent, it is possible that the jet chamber formed on both sides of the delivery device is at least largely integral with the casing cover and bearing flange, respectively. Likewise, it is possible that the jet chamber is associated to the actual casing and defined by the inside wall of the casing cover on the one hand and the inside wall of the bearing flange on the other hand. Both variants are realizable.

As previously stated, the fluid coming from the tank is divided in accordance with the invention on both sides of the delivery device. On these two sides of the delivery device, the fluid undergoes acceleration by injection into the respective jet chamber. In a particularly advantageous manner, the nozzle jets are inclined downward at an angle deviating as much as possible from 90°, preferably at an acute angle, and directed to the wall of the casing and/or bearing flange opposite to the outlet of the feed channel, so that the accelerated fluid impacts thereupon with a high energy, and escapes to both sides in accordance with the contour of the wall of the casing and/or bearing flange. Consequently, the fluid undergoes another distribution, namely on both sides of the delivery device, again over two separate flow paths on both sides of the central bore provided in the casing for the delivery device or the rotary group that forms the delivery device.

In an advantageous manner, the wall of the casing and, optionally, the wall of the bearing flange is designed and constructed such that it distributes the there-impacting and accelerated fluid approximately equally by a lateral runoff, and directs it in the way of a guiding device at least largely into suction channels formed on both sides. These suction channels lead to the direct suction zone of the delivery device. Concretely, the suction channels lead directly to the suction chambers of the delivery device, along two separate flow paths on both sides of the delivery device, so that the suction chambers of the delivery device are supplied in four separate locations with fluid under the same pressure and with the same volume of fluid, thereby ensuring a uniform admission of fluid to the delivery device.

Furthermore, it will be very advantageous, when the suction channels leading to the suction chambers are made at least largely of the same length to avoid varying pressure losses in the fluid.

In a further advantageous manner, a pressure control pilot is provided, which serves as an overload protection for limiting a maximum operating pressure on the high-pressure side. To this end the pressure pilot receives from the high-pressure side fluid, which is to be returned after flowing through the pressure control pilot. In a further advantageous manner, the feed channel communicates to this end with the pressure control pilot for returning the pilot oil. This flow connection may be realized in an advantageous manner, preferably via a channel labyrinth that is made integral with the casing, and/or the casing cover, and/or the bearing flange. At any rate, it will be of advantage, when this fluid is returned to the circulation system together with the fluid coming from the tank, directly upstream of the range of action of the injector device. Likewise, it is possible to supply to the fluid coming from the tank leakage oil, which is bound to emerge on the high-pressure side. To this end, leakage oil channels or a corresponding labyrinth of channels are provided, which carry the leakage oil from different collection points into the feed channel.

There exist various possibilities of improving and further developing the teaching of the present invention in an advantageous manner. To this end, reference may be made to the following description of embodiments of the invention with reference to the drawing. Likewise, in conjunction with the description of preferred embodiments of the invention with reference to the drawing, generally preferred improvements and further developments of the teaching are described in greater detail.

DETAILED DESCRIPTION OF THE PREFERRED EMBODIMENTS

Figure 1:
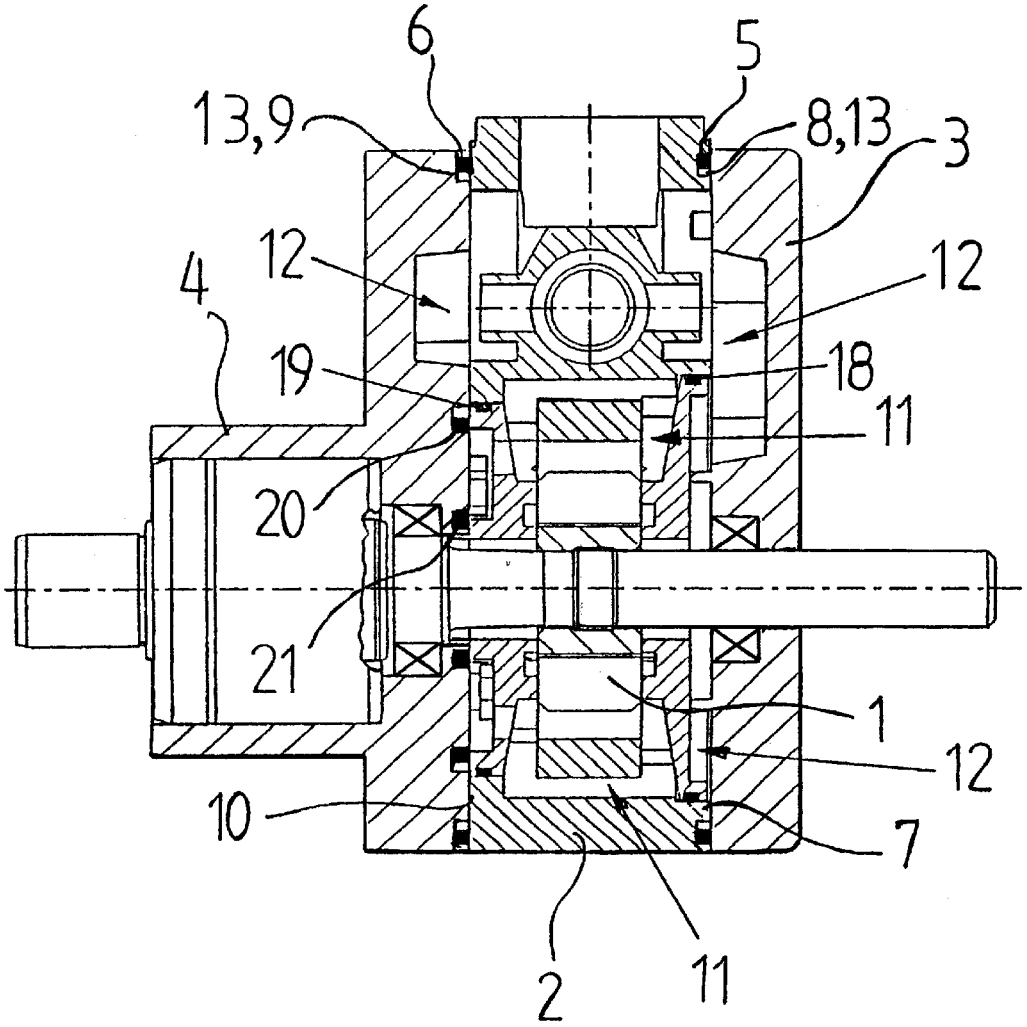
FIG. 1 is a schematic sectional side view of an embodiment of a rotary vane pump which embodies the invention.

FIG. 1 is a simplified illustration of a rotary vane pump in a sectional side view. Concretely, the pump is a vane-cell pump with a rotary group 1 or delivery device not described in greater detail. As regards the special configuration of such a rotary group 1 reference may be made, for example, to DE 39 28 029 A1.

The illustrated pump comprises as essential components, a casing 2 and a delivery device accommodated in the casing 2. This delivery device is the aforesaid rotary group 1. On the end faces, a casing cover 3 closing the casing 2 is provided on the on side, and on the other side, the side opposite to the casing cover 3, a bearing flange 4 that adjoins the casing 2.

Between the casing 2 and the casing cover 3 on the one hand, and between the casing 2 and the bearing flange 4 on the other hand, an outwardly operative seal 5, 6 is arranged. The seal 5, which is operative toward the casing cover 3 is inserted into a groove 8 formed in an end face 7 of the casing 2. On the other side of the casing 2, the seal 6 is associated to the bearing flange 4 or inserted into a groove 9 integral with the bearing flange 4. It is likewise possible to incorporate the groove 9 in an end face 10 of the casing 2.

It is already known from the state of the art to provide between a delivery side 11 and a suction side 12 of the pump, a leakage path for the fluid, namely a leakage path for leakage oil emerging on the delivery side that is to be delivered to the suction side.

In accordance with the invention the leakage path 13 is formed on the inner side of the seal at least in sections parallel to the seal 5, 6.

Figure 2:
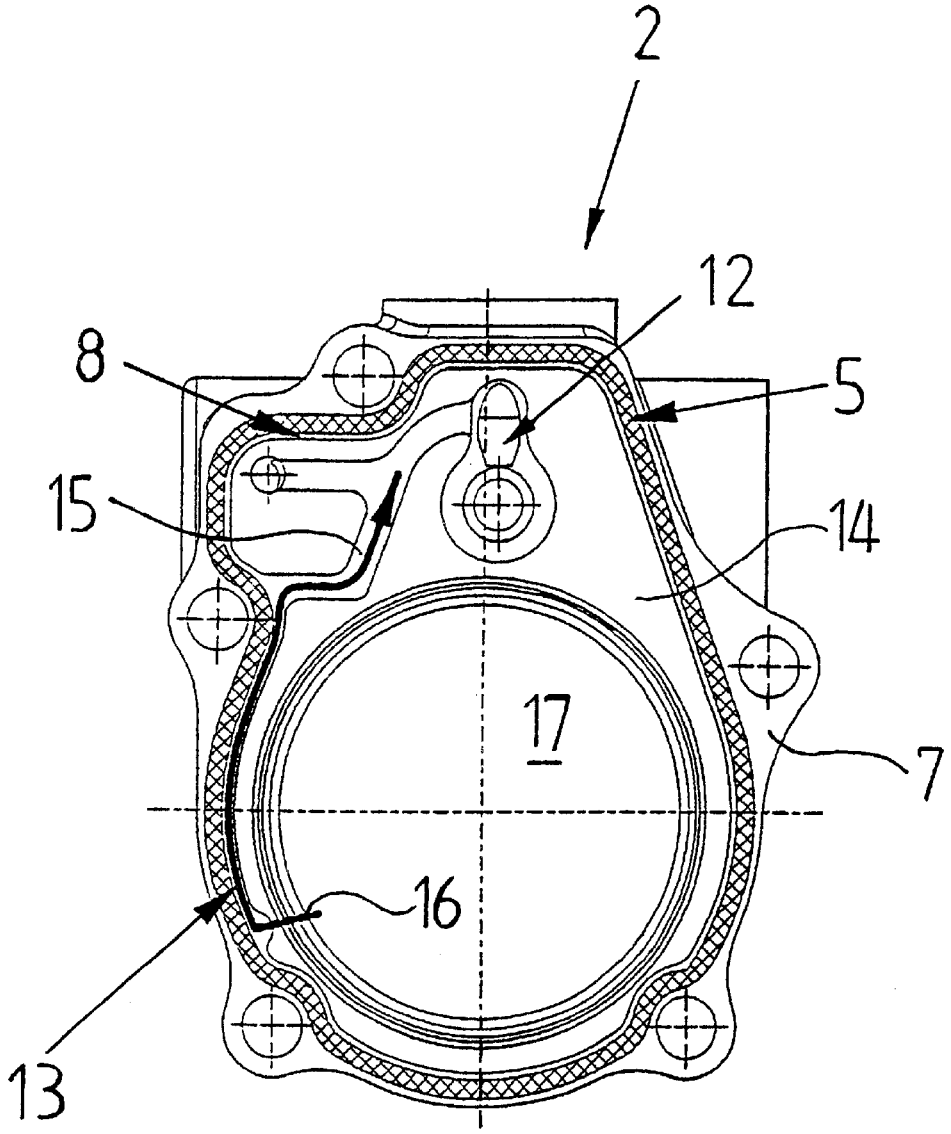
FIG. 2 is an end face view of the pump of FIG. 1, with a casing cover removed, wherein a groove forming a leakage path is made integral with the end face of the pump casing.
Figure 3:
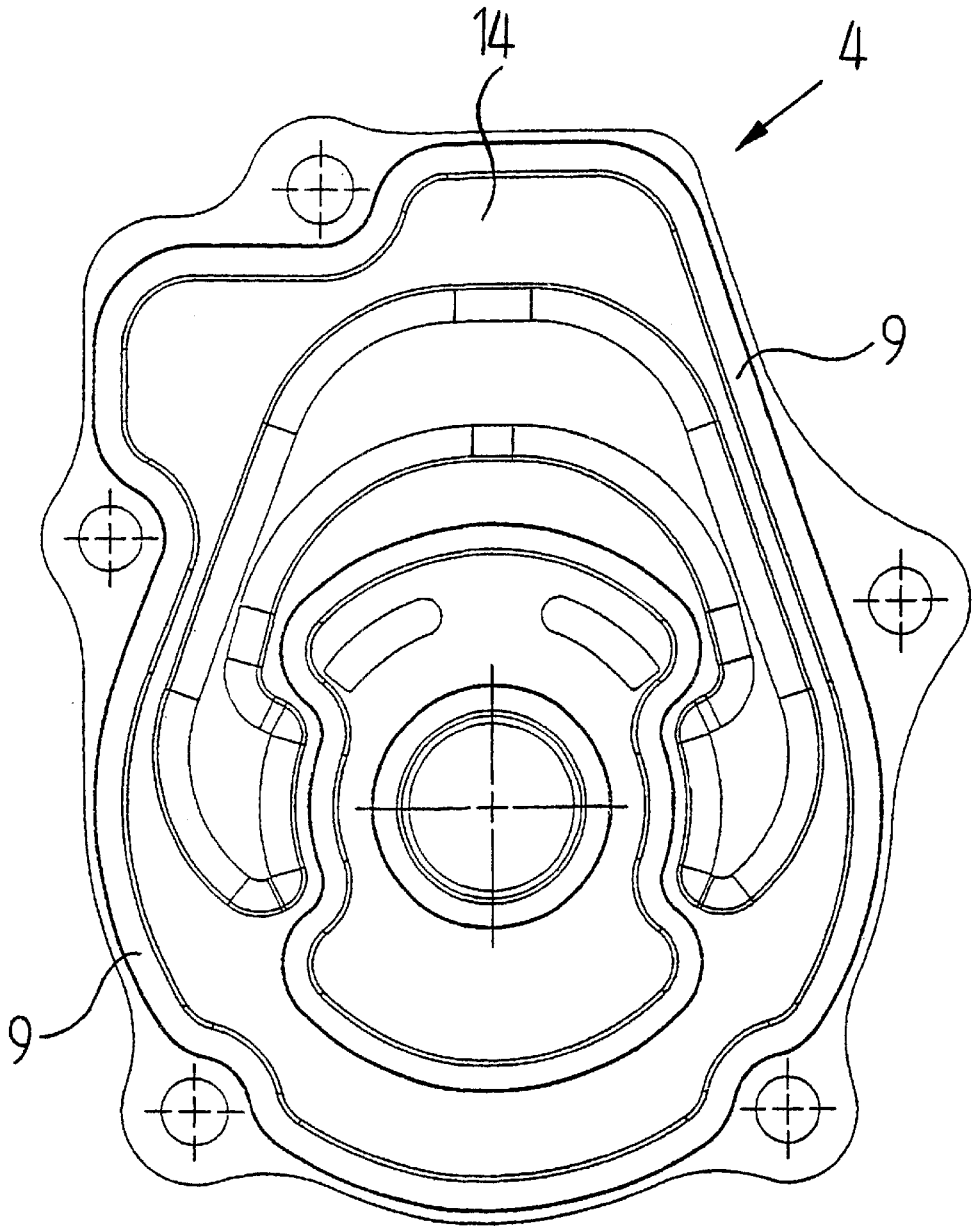
FIG. 3 is a schematic inside view of a bearing flange with an integral groove, but without a seal.

As best seen in FIG. 2, the groove 8 is made wider than the seal 5 for forming the leakage path 13, so that the leakage path 13 is formed on an inner side 14 of the seal parallel to the seal 5. Likewise, the leakage path 13 is formed by the groove 9 in bearing flange 4, with the seal 6 not being separately shown in the illustration of the bearing flange 4 in FIG. 3.

FIGS. 1–4 show jointly that the grooves 8, 9 are designed and constructed as self-contained annular grooves. Accordingly, the seals 5, 6 are realized as gaskets, with the leakage path 13 extending only over those sections of the grooves 8, 9, where leakage oil collects and needs to be removed. Only there is the leakage path 13 made integral with the grooves 8, 9. As regards the groove 8 formed in casing cover 3, this is best seen in FIG. 2.

As further indicated in FIG. 2, the widened portion of groove 8, which forms leakage path 13, communicates with the suction side 12 of the pump via an integral leakage oil channel 15. FIG. 2 further indicates, how a leakage oil 16 enters the leakage path 13, parallel to seal 5, i.e., how it enters groove 8, and how the leakage oil 16 is supplied from there, via leakage oil channel 15, to suction side 12 and, thus, to the tank oil.

Furthermore, as indicated in FIG. 1, the delivery side 11, i.e., the high pressure, is sealed at least quite predominantly inside the interior 17 of the casing or directly adjacent thereto. To this end, seals 18, 19, 20, 21 are provided, which are operative toward casing cover 3 and toward bearing flange 4. These seals are likewise gaskets and/or combination seals. Consequently, the first-mentioned seals 5, 6 are exposed to a substantially lesser pressure, close to the pressure on the suction side or the tank pressure, which assists the sealing effect of the pump as a whole quite considerably.

Figure 4:
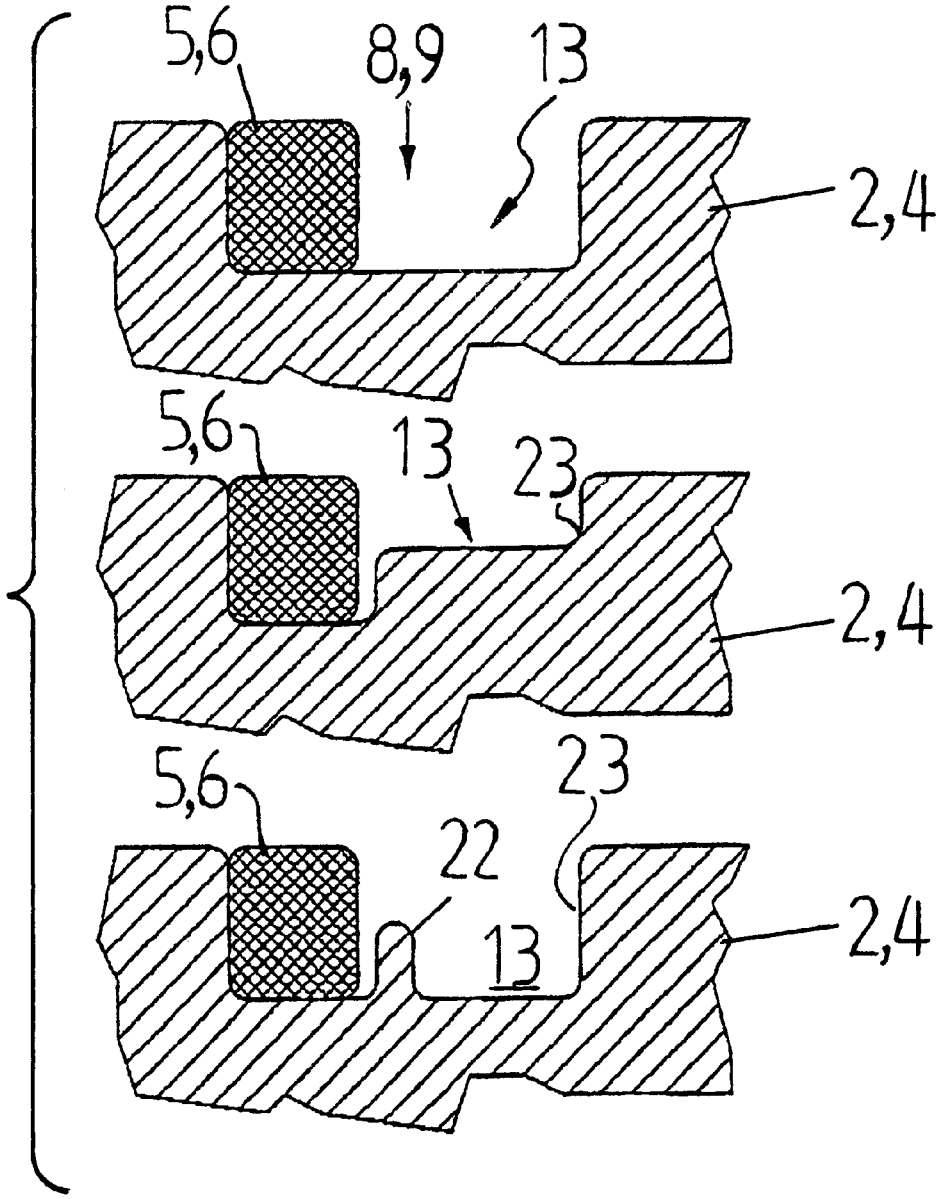
FIG. 4 shows in three schematic views, one below the other, three different embodiments of the groove comprising the leakage path.

FIG. 4 shows three concrete configurations of the groove. The groove may be both the groove 8 formed in the end face 7 of casing 2 and the groove 9 formed in bearing flange 4.

In the upper illustration, FIG. 4 shows that the groove 8 or 9 for forming the leakage path 13 is made substantially wider than is needed for receiving seal 5 or 6. As a result of this wider construction, the leakage path 13 is formed directly adjacent seal 5 or 6, respectively on the inner side of pressure.

The embodiment below thereof, as seen in the center of FIG. 4, shows a stepped configuration of the groove 8 or 9, with the seal 5 or 6 being arranged in the lower-lying groove bottom. The leakage path 13 extends on a somewhat higher level than the groove bottom of the lower lying groove region, which receives seal 5 or 6.

The lowest illustration in FIG. 4 shows a bipartite groove 8 or 9. Within the scope of this embodiment, the leakage path 13 is separated by a partition 22 from the region of the groove 8 or 9, which receives the seal 5 or 6. This partition 22 is made lower than an outside wall 23 of groove 8 or 9 and leakage path 13, respectively, so that in the case of an adequate amount of leakage oil, same is able to reach directly seal 5 or 6.

Figure 5:
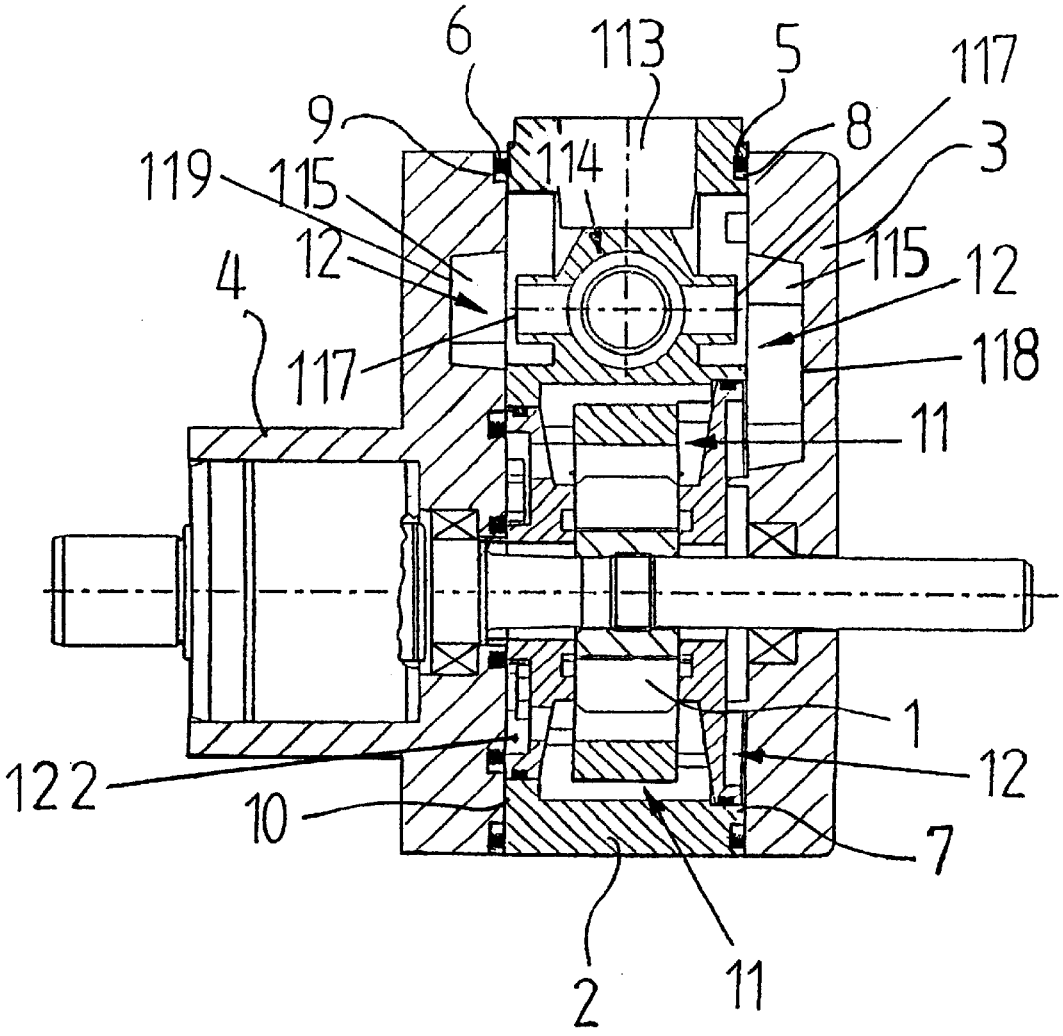
FIG. 5 is a schematic sectional side view of a further embodiment of a rotary vane pump.
Figure 6:
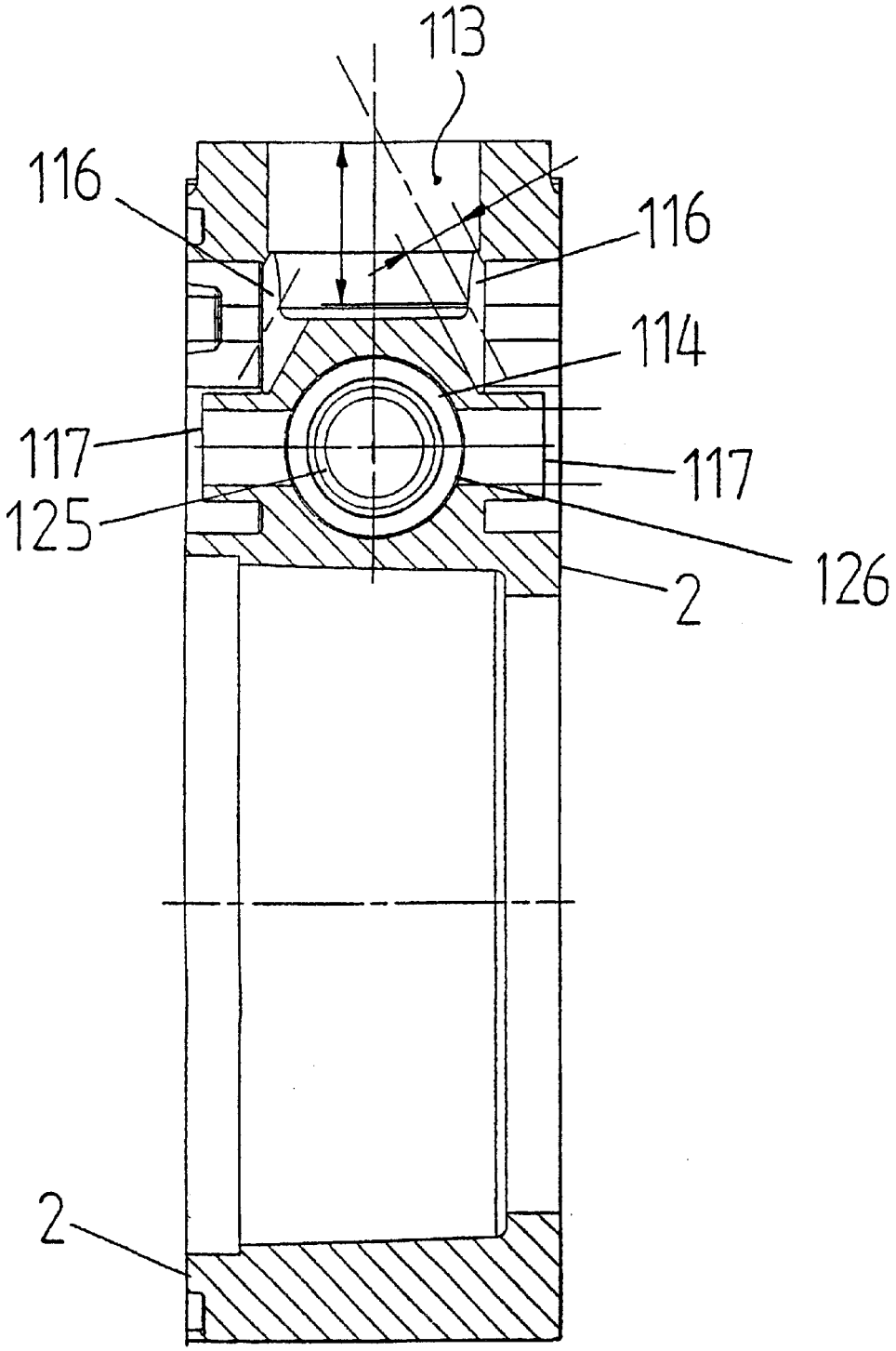
FIG. 6 is a schematic sectional side view of the pump of FIG. 5, without casing cover, without bearing flange, and without delivery device.

As best seen in FIGS. 5 and 6, a feed channel 113 for the fluid extends into the suction zone, i.e. toward the suction side 112. Furthermore, an injector device 114 serving to deliver the fluid is provided, which operates in a fashion similar to a water jet pump. This injector device 114 injects a high-pressure fluid into a jet chamber 115 upstream of the delivery device 1, and there into the fluid exiting from the feed channel 113, thereby accelerating or entraining the fluid.

On both sides of the delivery device 1, the feed channel 113 terminates respectively with one subchannel 116 into a separate jet chamber 115. The injector device 114 injects on two sides, so that one jet nozzle 117 of the injector device 114 is directed into each of the two jet chambers 115.

FIGS. 5 and 6 show jointly that the injector device 114 is arranged in the center above the delivery device 1. In this arrangement, the jet nozzles 117 are aligned such that the fluid injected under high pressure via the jet nozzle 117 impacts upon the fluid being accelerated approximately in the flow direction thereof, thereby assisting again an acceleration of the fluid coming from the tank. The fluid reaches the two jet nozzles 117 via the feed channel 113, valve bore 125, and discharge bores 126.

As further shown in FIGS. 5 and 6, the subchannels 116 of feed channel 113 that is divided on both sides of delivery device 1, are approximately of the same length, since the feed channel 113 is likewise evenly divided approximately in the center above the delivery device 1.

As can be noted from FIG. 5, the jet chamber 115 formed on both sides of the delivery device 1 is largely made integral with casing cover 3 on the one side and with bearing flange 4 on the other side. The jet nozzles 117 are orthogonally directed to a wall 118 of casing cover 3 opposite to the outlet of feed channel 113 on the one side, and to a wall 119 of bearing flange 4 opposite to the outlet of feed channel 113.

Figure 8:
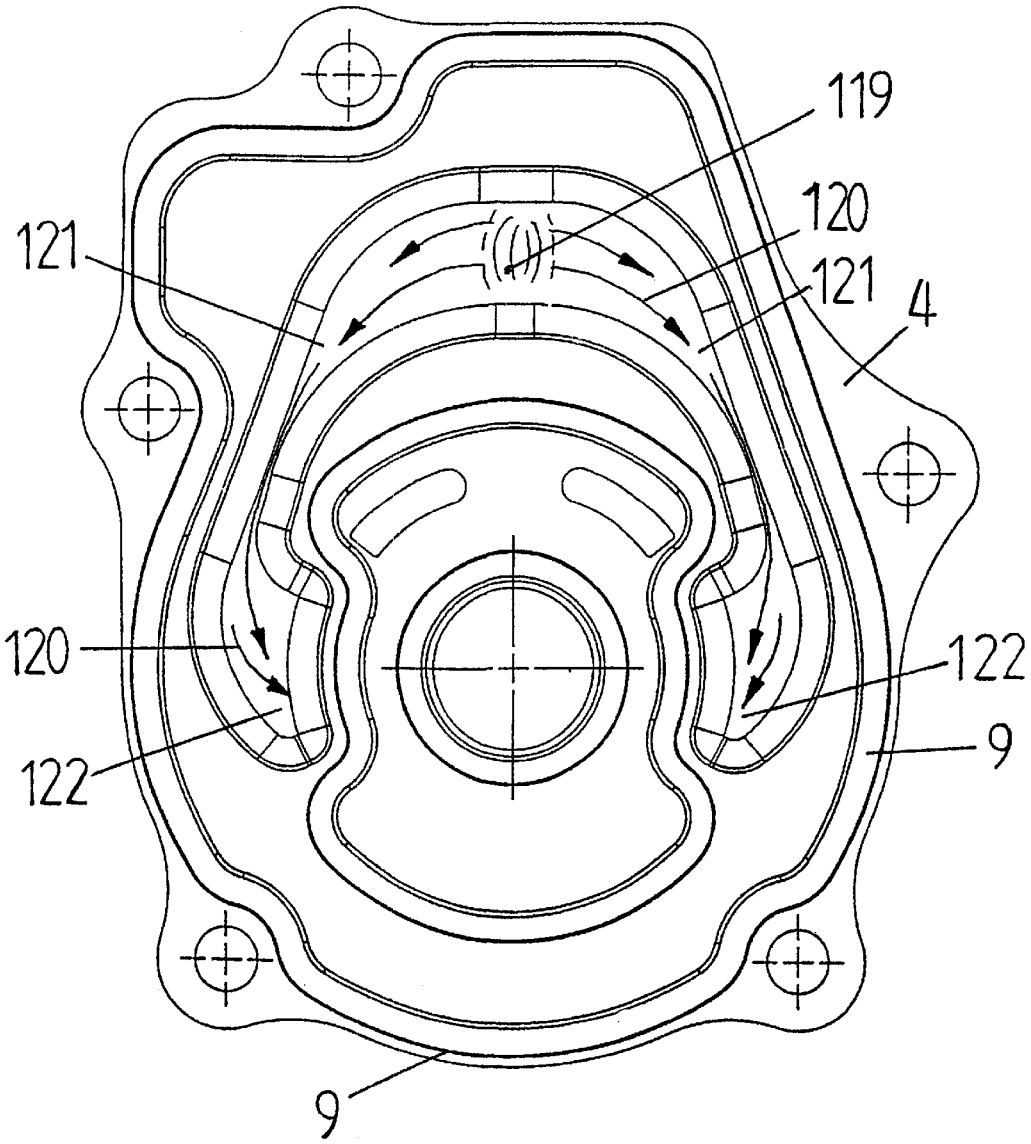
FIG. 8 is a schematic inside view of the bearing flange, whose wall is impacted by the accelerated fluid.

According to the illustration of FIG. 8, the wall 119 of bearing flange 4 is designed and constructed such that it divides the there impacting and accelerated fluid approximately evenly by a lateral runoff. The flow path of the fluid is indicated at numeral 120. Last but not least, the walls 118, 119 direct the fluid in the fashion of a guiding device into suction channels 121 formed on both sides, so that the fluid is divided one more time. The suction channels 121 lead to suction chambers of delivery device 1. These suction chambers are arranged downstream of a direct suction zone 122 of delivery device 1.

Figure 7:
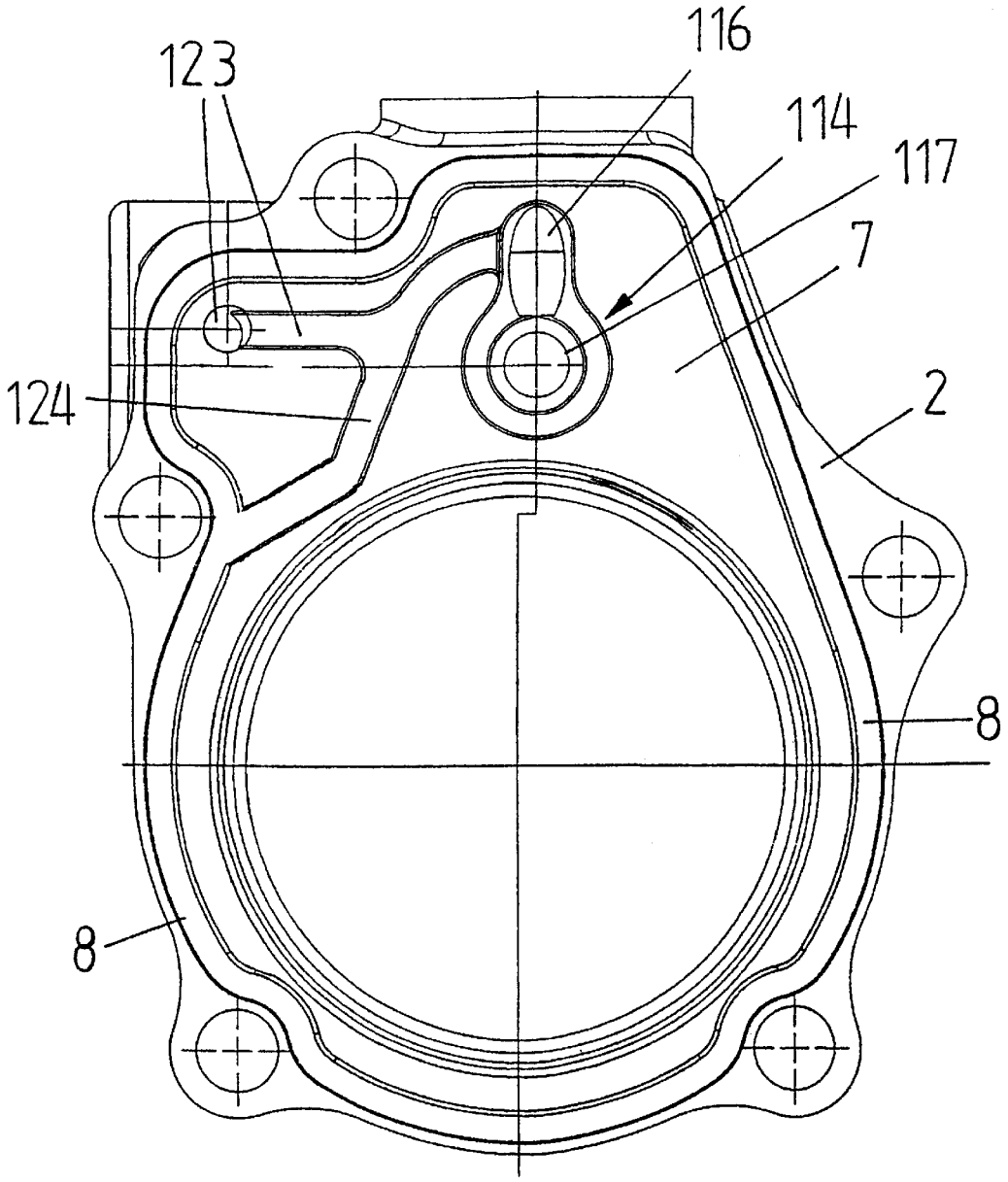
FIG. 7 is an end face view of the pump of FIG. 6 with the casing cover removed, which shows the outlet of a feed channel and of an injector device into a jet chamber.

Furthermore, as best seen in FIG. 8, the suction channels 121 leading to the suction chambers or to the suction zone 122 are made of approximately the same length, so that in the suction zone 122, identical pressure conditions exist on both sides, and an identical volume of fluid is made available. Naturally, the foregoing statements apply likewise to the situation on the sides of casing cover 3. In this case, FIG. 7 is only an end face view of the casing 2 opposite to the casing cover, wherein the outlets of feed channel 113 or subchannel 116 and of injector device 114 or jet nozzle 117 are shown. A separate illustration of wall 118 of casing cover 3 according to the illustration of bearing flange 4 in FIG. 8 is left off for the sake of simplicity.

As further shown in FIG. 7, the feed channel 113 communicates with a pressure control pilot for returning pilot oil, namely via a special pilot oil channel 123. Furthermore, a leakage oil channel 124 terminates in feed channel 113, so that returned pilot oil and leakage oil mix within the feed channel 113 with the fluid coming from the tank. After leaving respectively the feed channel 113 and subchannel 116, the there-developing total quantity of fluid is supplied via the injector device 114, or via discharge bores 126, and via jet nozzles 117 with a high-pressure fluid, and is thereby accelerated.

Finally, it should be emphasized that the foregoing embodiment merely given by way of example describes only the teaching of the invention in greater detail, without however limiting it to the embodiment.

What is claimed is:

1. A pump for delivering a fluid comprising a casing which defines an interior chamber, opposite end faces, and a delivery side and a suction side, a delivery device accommodated in the interior chamber of the casing for displacing a fluid from the suction side to the delivery side, a casing cover overlying and closing one of the end faces, and a bearing flange overlying and closing the other of the end faces, a seal disposed between at least one of (1) the casing cover and the one end face and (2) the bearing flange and the other end face, and a fluid leakage path extending between the delivery side and the suction side, with at least a portion of the leakage path extending along the inner side of the seal.

2. The pump as defined in claim 1 wherein the seal is disposed in a groove which is substantially wider than the seal so that the groove forms at least a portion of the leakage path on the inner side of the seal.

3. The pump as defined in claim 2 wherein the groove is of continuous annular form.

4. The pump as defined in claim 3 wherein the seal comprises a gasket.

5. The pump as defined in claim 2 wherein the groove defines a generally flat bottom wall.

6. The pump as defined in claim 2 wherein the groove defines a bottom wall which is stepped so as to define a relatively deep segment and a relatively shallow segment, with the seal being disposed in the relatively deep segment.

7. The pump as defined in claim 2 wherein the groove defines a bottom wall which is divided by a partition extending along a medial portion thereof, with the seal being disposed on one side of the partition.

8. The pump as defined in claim 2 wherein the leakage path formed by the groove communicates with the suction side of the pump in at least one location.

9. The pump as defined in claim 8 wherein the communication between the groove and the suction side of the pump is formed by a bore or recess extending from the suction side into the groove.

10. The pump as defined in claim 8 wherein the communication between the groove and the suction side of the pump includes a labyrinth.

11. The pump as defined in claim 1 further comprising additional sealing members positioned to seal the delivery side within the interior chamber of the casing.

12. The pump as defined in claim 11 wherein at least a plurality of said additional sealing members are disposed between the casing cover and the one end face and/or between the bearing flange and the other end face.

13. The pump as defined in claim 12 wherein said additional sealing members comprise gaskets.

14. A pump for delivering a fluid comprising a casing which defines an interior chamber, opposite end faces, and a delivery side and a suction side, a delivery device accommodated in the interior chamber of the casing for displacing a fluid from the suction side to the delivery side, a casing cover overlying and closing one of the end faces, and a bearing flange overlying and closing the other of the end faces, a seal disposed between each of (1) the casing cover and the one end face and (2) the bearing flange and the other end face, and a fluid leakage path extending between the delivery side and the suction side, with at least a portion of the leakage path extending along the inner side of each seal.

15. The pump as defined in claim 14 wherein each seal is disposed in a respective groove which is substantially wider than the seal so that the groove forms at least a portion of the leakage path on the inner side of the associated seal.

* * * * *